US007665769B2

(12) United States Patent
Lenhart

(10) Patent No.: US 7,665,769 B2
(45) Date of Patent: Feb. 23, 2010

(54) POLE GRIP COMPRISING AN ADJUSTABLE HAND STRAP

(75) Inventor: Klaus Lenhart, Ohmden (DE)

(73) Assignee: Lekisport AG, Baar (CH)

( * ) Notice: Subject to any disclaimer, the term of this patent is extended or adjusted under 35 U.S.C. 154(b) by 218 days.

(21) Appl. No.: 11/792,479

(22) PCT Filed: Dec. 7, 2005

(86) PCT No.: PCT/CH2005/000727

§ 371 (c)(1),
(2), (4) Date: Jun. 7, 2007

(87) PCT Pub. No.: WO2006/060932

PCT Pub. Date: Jun. 15, 2006

(65) Prior Publication Data

US 2008/0012286 A1 Jan. 17, 2008

(30) Foreign Application Priority Data

Dec. 10, 2004 (CH) ..... 2052/04

(51) Int. Cl.
*A63C 11/22* (2006.01)

(52) U.S. Cl. ..... 280/822; 280/819; 135/76

(58) Field of Classification Search ..... 280/819, 280/821, 822; 16/428; 135/76
See application file for complete search history.

(56) References Cited

U.S. PATENT DOCUMENTS 3,113,786 A 12/1963 Phillipson
3,560,014 A * 2/1971 Bruckl et al. ..... 280/821

(Continued)

FOREIGN PATENT DOCUMENTS

DE 78 20 999 U1 11/1978

(Continued)

*Primary Examiner*—Jeffrey J Restifo
(74) *Attorney, Agent, or Firm*—Sughrue Mion, PLLC

(57) ABSTRACT

A pole grip, especially for canes, trekking poles, downhill skiing poles, cross-county skiing poles, and Nordic walking poles. The pole grip includes a grip member and a hand-retaining device in the form of a hand strap or a glove. The hand-retaining device is equipped with a substantially band-shaped element which is provided with an end that is fixed inside the recess in the area of the top wall on the grip member. The pole grip includes a blocking element disposed which releases both the band section that penetrates into the grip member and the band section protruding from the grip member in the direction of the loose end while allowing the useful length to be adjusted when the hand-retaining device is oriented upward, the deflecting element blocks both the band section that penetrates into the grip member and the band section protruding from the grip member towards the loose end when the hand-retaining device is oriented downward, thus making it possible to provide a very reliable and simply designed adjustable hand-retaining device on a pole grip.

25 Claims, 4 Drawing Sheets

U.S. PATENT DOCUMENTS

| | | | | | |
|---|---|---|---|---|---|
| 4,130,293 | A * | 12/1978 | Hinterreiter | 280/822 |
| 4,288,100 | A * | 9/1981 | Aho | 280/821 |
| 4,288,101 | A * | 9/1981 | Aho | 280/821 |
| 4,416,036 | A * | 11/1983 | Aho | 24/136 R |
| 6,139,060 | A * | 10/2000 | Lenhart | 280/821 |
| 6,439,610 | B1 * | 8/2002 | Pronzati | 280/822 |
| 6,851,437 | B1 * | 2/2005 | Lenhart | 135/72 |
| 7,191,495 | B2 * | 3/2007 | Panizza | 16/436 |
| 2002/0067036 | A1 * | 6/2002 | Young et al. | 280/819 |
| 2008/0012286 | A1 * | 1/2008 | Lenhart | 280/821 |
| 2008/0036191 | A1 * | 2/2008 | Lenhart | 280/821 |
| 2008/0149154 | A1 * | 6/2008 | Lenhart | 135/65 |
| 2008/0169635 | A1 * | 7/2008 | Panizza | 280/822 |

FOREIGN PATENT DOCUMENTS

| | | | |
|---|---|---|---|
| DE | 196 32 718 | A1 | 7/1997 |
| DE | 299 06 612 | U1 | 8/2000 |
| DE | 201 14 396 | U1 | 1/2003 |
| DE | 203 11 805 | U1 | 10/2003 |
| EP | 1 118 362 | A2 | 7/2001 |

* cited by examiner

POLE GRIP COMPRISING AN ADJUSTABLE HAND STRAP

TECHNICAL FIELD

The present invention relates to a pole grip, in particular for walking sticks, trekking poles, downhill ski poles, cross-country ski poles and Nordic walking poles, having a grip body and a hand-retaining arrangement in the form of a hand strap or of a glove, the hand-retaining arrangement being of adjustable length.

PRIOR ART

Walking sticks, trekking poles, downhill ski poles, cross-country ski poles and also Nordic walking poles normally have, at their top end, a pole grip which is gripped by the hand. In order to avoid accidental loss of the pole and to transmit the force of the user's hand to the pole, a hand strap is usually fastened on this pole grip, the hand being guided through this hand strap before it grips the pole grip.

Such hand straps can usually be adjusted to different hand sizes, and to use with or without gloves, since their length can be varied. In this respect, there are a number of possible ways of fastening hand straps on the pole grip in a variable manner.

In the first instance, it is possible to fasten the band of the hand strap in or on the pole grip by means of a screw and to provide different positions for the screw to be screwed tight.

There are also designs, however, which provide a strap-band fastening mechanism in which pulling the strap upward can change the length of the same and pulling the strap downward fixes the length of the strap. Such fastening mechanisms have, inter alia, the advantage that, for example if the user falls and the strap is pulled upward as a result, the hand strap is released and injuries to the hand, for example skier's thumb can be avoided.

Such designs are described, for example, in DE 19632718 C2 and also in EP 1118362 A2 or DE 29906612 U1.

SUMMARY OF THE INVENTION

The object of the invention is thus to provide an alternative and, in particular, improved pole grip which has a device for blocking and adjusting the useful length of the hand-retaining arrangement. It is a question here, in particular, of improving a pole grip, e.g. for walking sticks, trekking poles, downhill ski poles, cross-country ski poles and Nordic walking poles, having a grip body and a hand-retaining arrangement in the form of a hand strap or of a glove, it being the case that the hand-retaining arrangement is fastened on the grip body by way of a device for blocking and adjusting the useful length of the hand-retaining arrangement, that the grip body has a recess, and that the hand-retaining arrangement comprises an essentially band-like element. This band-like element, on the one hand, has an end fastened on the grip body, in the recess in the region of the top wall, (albeit not necessarily on this wall) and, on the other hand, it enters into the recess of the grip body, is deflected about a horizontally arranged deflecting element in the recess and exits out of the grip body in a downward direction as a free end.

This object is achieved by provision of means, as it were blocking means, which, when the hand-retaining arrangement is directed upward, release the band region entering into the grip body and the band region exiting out of the grip body to the free end and thus allow the useful length to be adjusted, and which, when the hand-retaining arrangement is directed downward, block both the band region entering into the grip body and the band region exiting out of the grip body to the free end. The means correspondingly press the band located beneath, or the two band portions located beneath, at least indirectly on to the base of the recess or specific elements provided there.

The core of the invention is thus inter alia, when the strap is directed downward, to use the means to block both the band region entering into the grip body and the band region exiting out of the grip body to the free end.

A first preferred embodiment of the invention is characterized in that the band region entering into the grip body and the band region exiting out of the grip body to the free end are arranged directly one above the other and, in the blocking position, are pressed one upon the other in blocking fashion by the means. In this way, the friction occurring between the two band regions can ensure in optimum fashion the blocking action of the means, when the strap is directed downward. It is preferable here for the band region exiting out of the grip body to the free end to be arranged beneath the band region entering into the grip body. This provides for the most convenient adjustability of the strap or, more generally, of the hand-retaining arrangement, in particular without any troublesome free end between the two fixed strap regions which enclose the hand.

According to a further preferred embodiment, the deflecting element is a pin which is arranged essentially horizontally in the recess and is mounted, for example, in the lateral walls of the recess, in corresponding bores of the grip body. The pin here may have a circular diameter, but it is also possible, for example in order to increase the friction of the encircling strap, to provide some other diameter, for example a square, rectangular or polygonal diameter. It is also possible, in order to increase the smooth-running properties, to provide a tubular sleeve around the pin. This pin is preferably secured in bores which pass all the way through at least on one side, in which case the pin can be pushed in, and fastened in the grip body from the outside.

A quite particularly preferred embodiment of the invention is characterized in that the means is a sheet-metal element which is elongate, preferably in the direction of the recess, the plane of which is provided essentially horizontally in the recess and can be rotated about a horizontal axis, and which has a downwardly angled region which, in the blocking position, is pressed onto the band region entering into the grip body and the band region located beneath, which exits out of the grip body to the free end. The axis of the rotatability of the sheet-metal element here is preferably arranged in a rear region of the recess, and the angled region is directed toward the front region of the recess.

The band region entering into the grip body is preferably guided around a pin, which is arranged essentially horizontally in the recess and is mounted in the lateral walls of the recess, in corresponding bores of the grip body and is guided out of the grip body underneath as free end. The sheet-metal element has a curved region which, at least over a surround angle of 100°, preferably at least over 120°, ends up located around the outside of that region of the band which is guided around the pin. In other words, the curved region of the sheet-metal element surrounds, at least in part, that region of the band guided around the pin which is directed away from the opening of the recess, and it is thus mounted in the recess such that it can be rotated about the pin without there being any possibility of the sheet-metal element falling out of the recess in the different positions of the strap. The sheet-metal element also has a rectilinear region which adjoins the curved region and has the downwardly angled region arranged at its end which is directed away from the pin (or possibly also offset to some extent in relation to the pin). The angled region here may be rectilinear along its edge which is directed toward the band which is located beneath and is to be fixed, this edge preferably being sharp-edged to the extent where, on the one hand, it is capable of fixing the band when the strap is positioned beneath it but, on the other hand the band is not damaged even after intensive use. As an alternative, or in addition, the edge may have toothing or the like provided at least over sections of the edge in order to be able to engage, for example, in plaited band in optimum fashion. Moreover, it is generally also possible, for better fixing on the bottom wall region of the recess, to provide additional fixing aids for the strap positioned beneath wherever the band located above is subjected to pressing by the means. These fixing aids may be friction-enhancing ribs or crosspieces provided on the base of the wall, in particular on the front edge of the base.

The curved region of the sheet-metal element preferably surrounds the band running around the pin by a surround angle of at least 150°, in order to ensure that the sheet-metal element is securely fixed in the direction of the opening of the recess.

Of course, the relative dimensions of this sheet-metal element have to be adapted both to the thickness and width of the band and to the space conditions in the recess. The length of the rectilinear portion of the sheet-metal element should always be smaller than the spacing between the hand-side opening of the recess and the pin, in order that the angled region presses the band located beneath at least indirectly onto the base of the recess. The rectilinear region and the angled region should thus be of such a length and height, respectively, that, when the strap band is directed downward the strap band fastened at the top, which exits out of the grip body, presses the sheet-metal element or the angled region thereof, downward onto the band region entering into the grip body and the band region located beneath, which exits out of the grip body to the free end, but that at the same time, when the strap is directed upward, adjustability without excess resistance is ensured.

It proves to be advantageous to form the sheet-metal element from a metal sheet, preferably from a steel sheet, with a thickness in the range of 0.2-1.5 mm, and to provide a height for the angled region of approximately 2-3 mm. In order to ensure optimum fixing of the band located beneath, the angled region of the sheet-metal element encloses for example a right angle, preferably an angle in the range of 70-110°, with the rectilinear region of the sheet-metal element.

At the fastened end, the strap band may simply be attached to the top wall of the recess via a screw which, for example for better accessability, can pass through the grip to the top side. It is also possible, however, to fasten the strap band on the grip body by means of a specifically provided tear-off arrangement, in order to increase the safety if the user falls. It is likewise possible for the strap band to be fastened on the grip body not directly, but indirectly, by being fastened on the rectilinear region of the sheet-metal element from above, e.g. via a rivet or a screw.

The sheet-metal element typically has a width which is adapted essentially to the width of the strap. For example, the sheet-metal element has a width in the range of 3-15 mm or, in the case of a strap band made for example of a woven material, a width of 5-25 mm. It is also quite possible here for the sheet-metal element to be somewhat narrower than the strap band.

A further preferred embodiment of the invention is characterized in that the strap band exiting out of the grip body is fastened on the wall which bounds the recess in the upward direction, and in that the means are fastened on the strap band, or integrally formed thereon, as a downwardly directed crosspiece. It is thus basically possible to dispense with an independently rotatable sheet-metal element in the recess, since the means are fastened directly on the strap band.

An alternative preferred embodiment in contrast, is characterized in that the strap band exiting out of the grip body is fastened on the wall which bounds the recess in the upward direction, and in that the means are provided in the form of a sheet-metal element which is likewise fastened on the wall which bounds the recess in the upward or rearward direction, beneath the strap band exiting out of the grip body, the sheet-metal element having a downwardly angled region on the side which is directed toward the opening of the recess of the grip body. Such a sheet-metal element, correspondingly, rather than being rotatable about the pin, can be rotated about its fastening point on the inner wall of the recess. The possibility of a means for prestressing the sheet-metal elements may be advantageous here. This is basically because the means are retained in the blocking position via a preferably adjustable prestressing means and allow adjustment only when the hand strap is deflected specifically in the upward direction.

The hand-retaining arrangement is preferably an encircling hand strap, preferably comprising a woven band which is made of synthetic fibres and has a width in the range of 5-25 mm.

Further preferred embodiments of the pole grip according to the invention are described in the further dependent claims.

BRIEF EXPLANATION OF THE FIGURES

The invention will be explained in more detail hereinbelow with reference to exemplary embodiments and in conjunction with the drawings, in which.

WAYS OF IMPLEMENTING THE INVENTION

Figure 1:
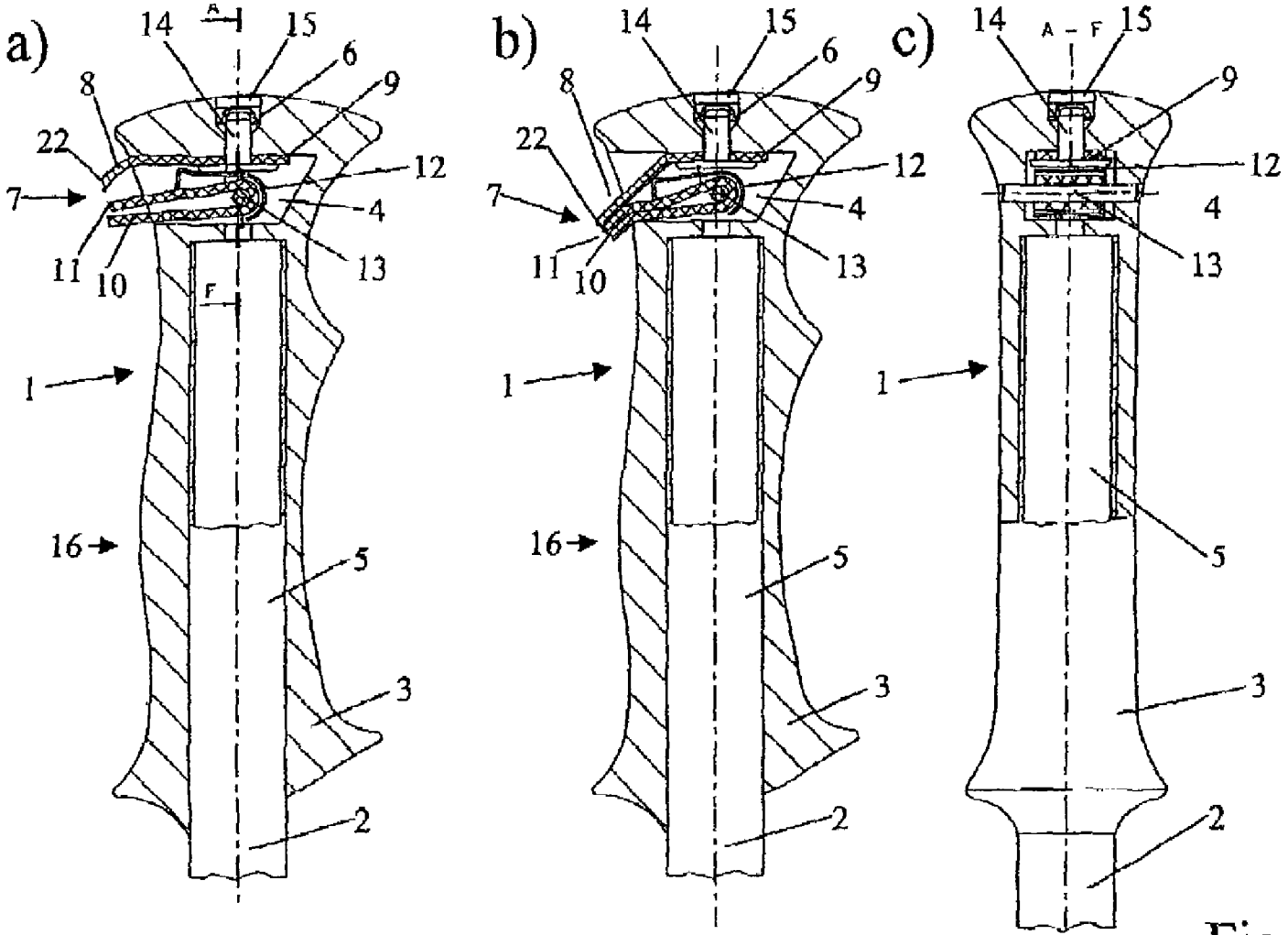
FIG. 1 shows sectional illustrations of a first pole grip in an adjusting position (a), in a clamping position (b) and in a section along A-F in FIG. 1*a*)

FIG. 1*a*) shows, in section, a pole grip 1 in a released position, i.e. in the adjusting position, in which the hand strap can be adjusted. FIG. 1*b*) and *c*) show supplementary views, the same designations having been used for the same elements. FIGS. 2*a*) and *b*) show details of the clamping position and the adjusting position and, here too, the same designations have been used for the same elements.

The pole grip 1 comprises a grip body 3 which, as seen from beneath, has a cavity 5 in the form of a recess into which the pole shaft 2 can be pushed. The grip 1 is formed in an ergonomic manner, i.e. the contour line of the hand-side 16 differs from that on the front side, which is directed forward.

In the top region, the pole grip 1 has an, as it were, horizontal recess 4 extending from the hand-side 16. This recess typically has a height in the range of 10-20 mm, normally a height of 12-14 mm. The width is adapted essentially to the width of the band 8 guided in this recess 4 and, for example in the case of a cross-country ski pole, Nordic walking pole or downhill ski pole, is approximately 10-20 mm. The end 9 of the hand strap 7, this end being fastened on the grip body, is fastened to the top wall of the recess 4 by means of a fastening element 14, specifically a plastic pin with a radial shoulder (collar) which is guided in a bore 6 which passes vertically through the head. The bore is covered, for example, by way of a covering stopper.

The strap band 8 exits out of the grip body as exiting strap band 22 and forms the hand strap, which wraps around the hand, and the other end enters into the recess 4 of the grip body 3, in turn, as strap band 11. If a glove with corresponding band means is provided here rather than a circling hand strap, then the strap band 11 is analogously the second band portion, which is fastened on the glove.

The strap band 11, which enters into the grip body 3 and whose width extends perpendicularly to the plane of the paper, is guided from above around a pin 13, provided in a stationary manner in the recess transversely to the band direction, and, after running around the pin, exits out of the grip body again by leaving the recess in a downward direction as free end 10.

Without the provision of additional fixing means, a hand strap guided in the grip body in this way is freely adjustable, and its length is not fixed, in any position. In order, however, then to ensure that the length of the hand strap is fixed when the hand strap 7 is directed downward, a fixing element 12 is provided in the recess. The fixing element is provided in the form of a metal sheet 12 which is approximately of the same width as the band and is, as it were, J-shaped in section. It has a curved region (cf., in particular, FIG. 2 in this respect) which surrounds the pin 13, and the band running around the pin 13, from the outside. The diameter of the curved region is adapted to the external diameter of the band running around the pin 13. By virtue of this, as it were, hook-like portion of the sheet-metal element 12, this sheet-metal element, on the one hand, is mounted for movement around the pin 13 and the band running around the same and, on the other hand, is, as it were, arrested in the recess 4.

The sheet-metal element 12 also has a rectilinear region 18 which adjoins the curved region and extends in the direction of the opening of the recess. Provided at the end of this rectilinear region 18 is a region 19 which is angled downward to the band portions 10, 11 located beneath.

If, then, as is illustrated in FIG. 1*a*) and in the detail in FIG. 2*b*), the strap is retained in the horizontal or upwardly directed position, then the fixing element can be pivoted loosely and exerts no pressure on the band portions 10 and 11 located beneath. Correspondingly, the length of the hand strap 7 can be adjusted in this position; in other words, the hand strap can be shortened by the free end 10 being pulled or can be lengthened by the strap band 11 entering into the grip body being pulled.

Moreover, when the hand strap is directed upward, it is always possible for the length of the hand strap to be increased, which is an automatic safeguard if the user falls.

If then, as is illustrated in FIG. 1*b*) and in the detail in FIG. 2*a*), the hand strap 7 is directed downward, as is typically the case during use, the portion of the strap band 22 exiting out of the grip body presses onto the fixing element, typically in the region of the front edge, i.e. where the rectilinear region 18 and the angled region 19 abut. The angled region 19 of the fixing element 12 is thus pressed downward onto the band portion 11, and thus also onto the second band portion 10 located beneath. The resulting friction fixes the length of the strap.

Figure 2:
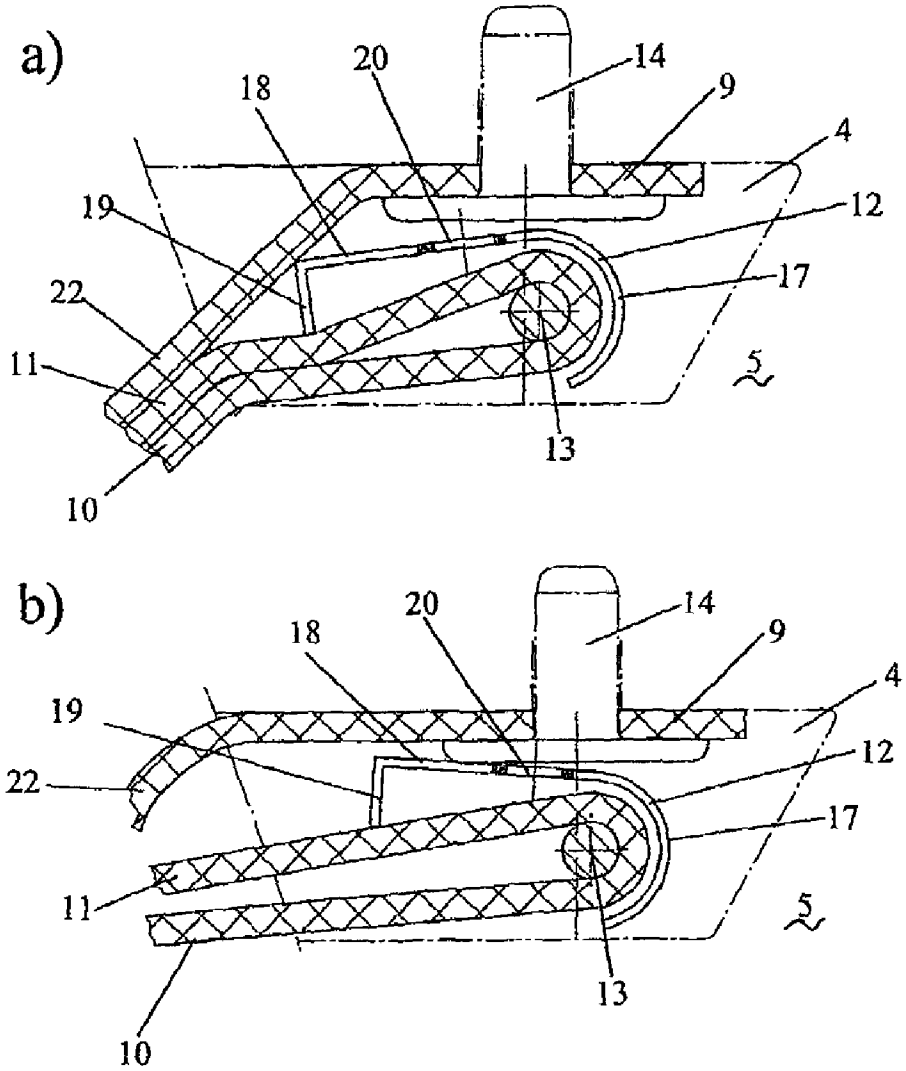
FIG. 2 shows sectional illustrations of details of the clamping position (a) and of the adjusting position (b)
Figure 3:
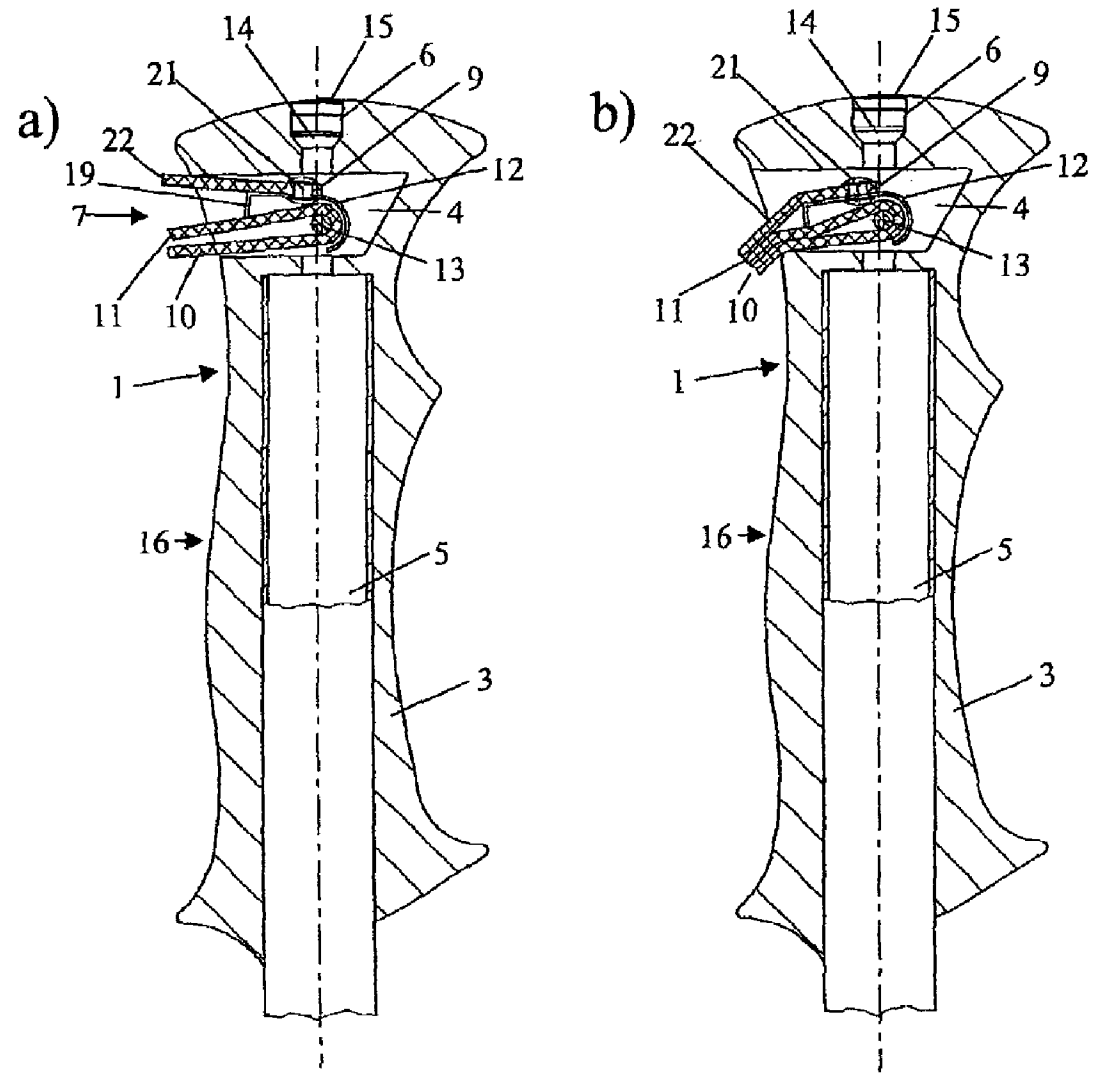
FIG. 3 shows sectional illustrations of a second pole grip in an adjusting position (a) and in a clamping position (b)

FIG. 3 illustrates an alternative exemplary embodiment, FIG. 3*a*) illustrating the adjusting position, in section, and FIG. 3*b*) illustrating the clamping position. Equivalent elements are designated by the same designations as in FIGS. 1 and 2.

In this exemplary embodiment, the end 9 of the hand strap 7, this end being fastened on the grip body 3, is fastened on the sheet-metal element 12 rather than directly on the grip body. In this case, it is attached to the rectilinear portion 18 from above by means of a fastening part 21, e.g. a rivet.

FIGS. 3*a*) and *b*) show that, even when the hand strap 7 is directed downward, the top portion 22 of the strap band exiting out of the grip body presses the sheet-metal element 12 downward such that the angled portion 19 fixes those portions 11 and 10 of the strap band which are located beneath.

Figure 4:
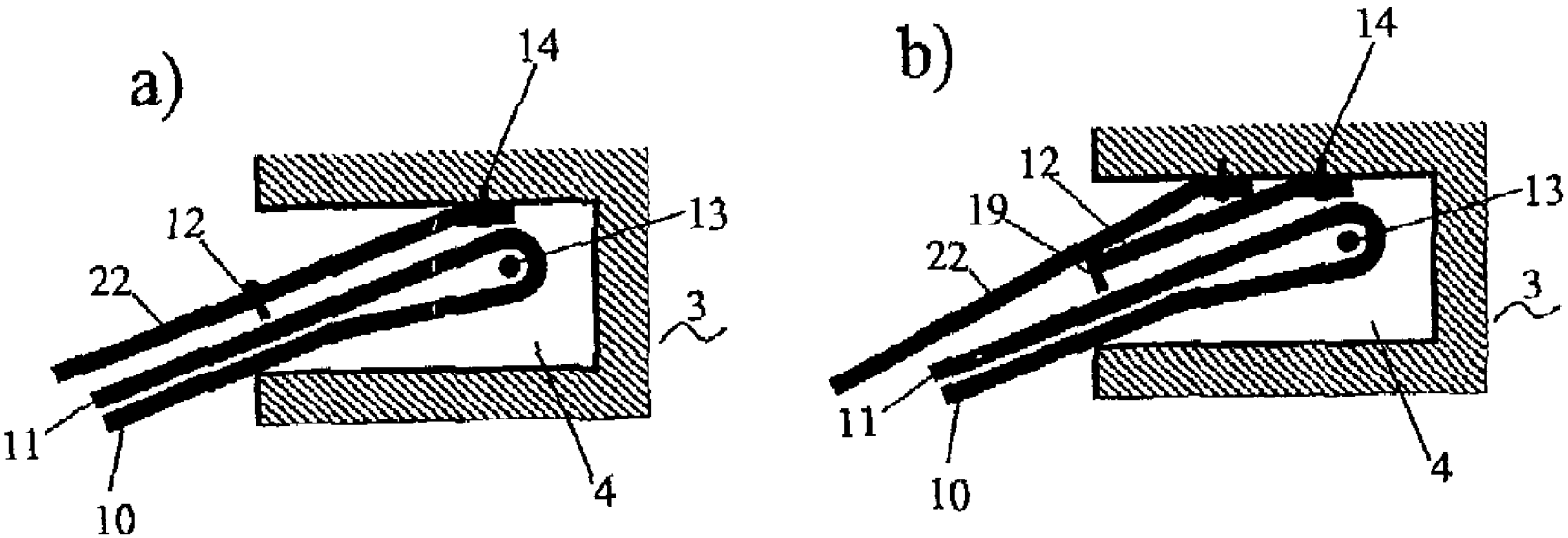
FIG. 4 shows variants of the clamping arrangement with, in a) the fixing element fastened on the strap and in b) the fixing element fastened on the top wall of the recess.

Finally, FIG. 4 shows options for the clamping arrangement which are basically different, but still fall within the scope of the invention. FIG. 4*a*) illustrates the option of the fixing element 12 being fastened directly on the strap band of the hand strap. That end of the hand strap 7 which is fastened on the grip body is fastened on the top wall of the recess 4 from beneath by means of a fastening element 14. A crosspiece, for example a crosspiece made of sheet metal, is either integrally formed or fastened on the strap band at a suitable spacing from the aforementioned fastening. The pivot point for the fixing element 12 is then the hand strap itself or the fastening point 14 thereof. In the clamping position, i.e. when the hand strap 7 is directed downward, the portion 22 of the strap band exiting out of the grip body will press the fixing element 12 downward onto the band portions 11 and 10 located beneath and thus give rise to a similar effect to that already illustrated in FIGS. 1-3.

This solution is particularly straight forward in design terms and, correspondingly, is not susceptible to malfunctioning even at low temperatures and if icing up occurs.

Another option is illustrated in FIG. 4*b*). Instead of the sheet-metal element with curved portion, this figure provides a sheet-metal element 12 which is fastened on the top wall of the recess 4 at one end by means of the fastening element 14. It has a rectilinear portion, which extends to the opening of the recess, and, essentially at the end of the rectilinear portion, an angled region 19. The point of rotation for this fixing element 12, is as it were, the fastening point on the wall of the recess 4. The end 9 of the hand strap fastened on the grip body is fastened on the wall of the recess above this fixing element and in a position in which it is offset some way in the direction of the opening of the recess 4.

In the clamping position, i.e. when the hand strap 7 is directed downward, the strap band 22 exiting out of the grip body presses onto the fixing element 12 from above, and the angled portion 19 is correspondingly pressed onto the two band portions 11 and 10, which, in turn, gives rise to a similar effect to that which has already been illustrated in FIGS. 1-3. This solution is also distinguished by simplicity of design. It is further possible, by adjusting the angle between the fastening and the rectilinear region of the sheet-metal element, to give rise to prestressing, for example, in the downward direction in which case only a specific upward movement of the strap actually results in the strap being released.

The exemplary embodiments cited serve only to give a general illustration of the idea according to the invention and should not be used to interpret in a restrictive manner the general main idea as formulated in the patent claims.

LIST OF DESIGNATIONS

1 pole grip
2 pole shaft

3 grip body
4 recess in 3
5 cavity in 3 for 2
6 bore
7 hand strap
8 strap band
9 end of 7 fastened on the grip body
10 free end of 7
11 strap band entering into the grip body
12 fixing element
13 transverse pin
14 fastening element
15 covering stopper
16 hand-side of grip body
17 curved region of 12
18 rectilinear region of 12
19 angled region of 12
20 bore in 18
21 fastening part
22 strap band exiting out of the grip body

The invention claimed is:

1. A pole grip having a grip body and a hand-retaining arrangement in the form of a hand strap or of a glove, wherein the hand-retaining arrangement is fastened on the grip body by way of a device for blocking and adjusting the useful length of the hand-retaining arrangement, wherein the grip body has a recess, and wherein the hand-retaining arrangement comprises an essentially band-like element which, has an end fastened on the grip body, in the recess in the region of the top wall, and which enters into the recess of the grip body, is deflected about a horizontally arranged deflecting element in the recess and exits out of the grip body in a downward direction as a free end, wherein a blocking element is provided which, when the hand-retaining arrangement is directed upward, releases the band region entering into the grip body and the band region exiting out of the grip body to the free end and allows the useful length to be adjusted, and which, when the hand-retaining arrangement is directed downward blocks both the band region entering into the grip body and the band region exiting out of the grip body to the free end and wherein the deflecting element is a pin which is arranged essentially horizontally in the recess and is mounted in the lateral walls of the recess, in corresponding bores of the grip body.

2. The pole grip as claimed in claim 1, wherein the bores for the pin pass all the way through at least on one side, in which case the pin can be pushed in from the outside.

3. The pole grip as claimed in claim 1, wherein the band region entering into the grip body and the band region exiting out of the grip body to the free end are arranged directly one above the other and, in the blocking position, are pressed one upon the other in blocking fashion by the sheet metal element, the band region which exits out of the grip body to the free end being arranged beneath the band region entering into the grip body.

4. A pole grip having a grip body and a hand-retaining arrangement in the form of a hand strap or of a glove, wherein the hand-retaining arrangement is fastened on the grip body by way of a device for blocking and adjusting the useful length of the hand-retaining arrangement, wherein the grip body has a recess, and wherein the hand-retaining arrangement comprises an essentially band-like element which, has an end fastened on the grip body, in the recess in the region of the top wall, and which enters into the recess of the grip body, is deflected about a horizontally arranged deflecting element in the recess and exits out of the grip body in a downward direction as a free end, wherein a blocking element is provided which, when the hand-retaining arrangement is directed upward, releases the band region entering into the grip body and the band region exiting out of the grip body to the free end and allows the useful length to be adjusted, and which, when the hand-retaining arrangement is directed downward, blocks both the band region entering into the grip body and the band region exiting out of the grip body to the free end wherein the blocking element is a sheet-metal element which is provided for vertical movement in the recess and has a downwardly angled region which, in the blocking position, is pressed onto the band region entering into the grip body and the band region located beneath, which exits out of the grip body to the free end.

5. The pole grip as claimed in claim 4, wherein the band region entering into the grip body is guided around a pin, which is arranged essentially horizontally in the recess and is mounted in the lateral walls of the recess, in corresponding bores of the grip body, and is guided out of the grip body underneath as free end, wherein the sheet-metal element has a curved region which, at least over a surround angle of 100° ends up located around the outside of that region of the band which is guided around the pin, and wherein the sheet-metal element has a rectilinear region which adjoins the curved region and has the downwardly angled region arranged at its end which is directed away from the pin.

6. The pole grip as claimed in claim 5, wherein the surround angle is at least 150°.

7. The pole grip as claimed in claim 5, wherein the rectilinear region and the angled region are of such a length and height, respectively, that, when the strap band is directed downward, the strap band fastened at the top, which exits out of the grip body, presses the sheet-metal element, or the angled region thereof, downward onto the band region entering into the grip body and the band region located beneath, which exits out of the grip body to the free end.

8. The pole grip as claimed in claim 5, wherein the sheet-metal element is formed from a metal sheet with a thickness in the range of 0.2-0.7 mm, and wherein the height of the angled region is 2-3 mm.

9. The pole grip as claimed in claim 5, wherein the angled region of the sheet-metal element encloses essentially a right angle with the rectilinear region of the sheet-metal element.

10. The pole grip as claimed in claim 5, wherein the strap band is fastened on the grip body by being fastened on the rectilinear region of the sheet-metal element from above.

11. The pole grip as claimed in claim 5, wherein the sheet-metal element has a width in the range of 3-15 mm.

12. The pole grip as claimed in claim 5, wherein the sheet metal element is formed from a steel sheet, with a thickness in the range of 0.2 0.7 mm and wherein the height of the angled region is 2 3 mm.

13. The pole grip as claimed in claim 5, wherein the angled region of the sheet metal element encloses an angle in the range of 70 110°, with the rectilinear region of the sheet metal element.

14. The pole grip as claimed in claim 5, wherein the strap band is fastened on the grip body by being fastened on the rectilinear region of the sheet metal element from above via a rivet or a screw.

15. The pole grip as claimed in claim 5, wherein the sheet metal element has a width in the range of 3 15 mm, and wherein the strap band is formed from a woven material with a width of 5 25 mm.

16. The pole grip as claimed in claim 4, wherein the band region entering into the grip body is guided around a pin, which is arranged essentially horizontally in the recess and is mounted in the lateral walls of the recess, in corresponding bores of the grip body, and is guided out of the grip body underneath as free end, wherein the sheet metal element has a curved region which, at least over a surround angle of at least over 120° ends up located around the outside of that region of the band which is guided around the pin, and wherein the sheet metal element has a rectilinear region which adjoins the curved region and has the downwardly angled region arranged at its end which is directed away from the pin.

17. The pole grip as claimed in claim 4, wherein the deflecting element is a pin which is arranged essentially horizontally in the recess and is mounted in the lateral walls of the recess, in corresponding bores of the grip body wherein the bores for the pin pass all the way through at least on one side, in which case the pin can be pushed in from the outside.

18. The pole grip as claimed in claim 1 or claim 4, wherein the band region entering into the grip body and the band region exiting out of the grip body to the free end are arranged directly one above the other and, in the blocking position, are pressed one upon the other in blocking fashion by the blocking element.

19. The pole grip as claimed in claim 1 or claim 4, wherein the strap band exiting out of the grip body is fastened on the wall which bounds the recess in the upward direction, and wherein the sheet metal element is fastened on the strap band, or integrally formed thereon, as a downwardly directed cross-piece.

20. The pole grip as claimed in claim 1 or claim 4, wherein the sheet metal element is retained in the blocking position via a prestressing element and allows adjustment only when the hand strap is deflected specifically in the upward direction.

21. The pole grip as claimed in claim 1 or claim 4, wherein the hand-retaining arrangement is an encircling hand strap.

22. The pole grip as claimed in claim 1 or claim 4, wherein it is for walking sticks, trekking poles, downhill ski poles, cross-country ski poles and Nordic walking poles.

23. The pole grip as claimed in claim 1 or claim 4, wherein the element is retained in the blocking position via an adjustable prestressing element and allows adjustment only when the hand strap is deflected specifically in the upward direction.

24. The pole grip as claimed in claim 1 or claim 4, wherein the hand retaining arrangement is an encircling hand strap comprising a woven band which is made of synthetic fibres and has a width in the range of 5 25 mm.

25. A pole grip having a grip body and a hand-retaining arrangement in the form of a hand strap or of a glove, wherein the hand-retaining arrangement is fastened on the grip body by way of a device for blocking and adjusting the useful length of the hand-retaining arrangement, wherein the grip body has a recess, and wherein the hand-retaining arrangement comprises an essentially band-like element which, has an end fastened on the grip body, in the recess in the region of the top wall, and which enters into the recess of the grip body, is deflected about a horizontally arranged deflecting element in the recess and exits out of the grip body in a downward direction as a free end, wherein a blocking element is provided which, when the hand-retaining arrangement is directed upward, releases the band region entering into the grip body and the band region exiting out of the grip body to the free end and allows the useful length to be adjusted, and which, when the hand-retaining arrangement is directed downward, blocks both the band region entering into the grip body and the band region exiting out of the grip body to the free end, and wherein the strap band exiting out of the grip body is fastened on the wall which bounds the recess in the upward direction, and wherein the blocking element is provided in the form of a sheet-metal element which is likewise fastened on the wall which bounds the recess in the upward or rearward direction beneath the strap band exiting out of the grip body, the sheet-metal element having a downwardly angled region on the side which is directed toward the opening of the recess of the grip body.

* * * * *